United States Patent [19]

Marchese

[11] 4,155,212

[45] May 22, 1979

[54] MEAT WRAPPING DEVICE

[76] Inventor: Gerald J. Marchese, 920 Merry La., Oak Brook, Ill. 60521

[21] Appl. No.: 848,152

[22] Filed: Nov. 3, 1977

[51] Int. Cl.[2] ..... B65B 39/06
[52] U.S. Cl. ..... 53/258; 53/581
[58] Field of Search ..... 53/193, 197, 258

[56] References Cited

U.S. PATENT DOCUMENTS

| | | | |
|---|---|---|---|
| 2,908,123 | 10/1959 | Muller et al. | 53/193 X |
| 3,732,113 | 5/1973 | Walters | 53/258 X |

FOREIGN PATENT DOCUMENTS

| | | | |
|---|---|---|---|
| 1427998 | 3/1976 | United Kingdom | 53/197 |

*Primary Examiner*—Travis S. McGehee

*Attorney, Agent, or Firm*—Blanchard, Flynn, Thiel, Boutell & Tanis

[57] ABSTRACT

Mechanism for wrapping a resilient envelope, as a netting, around a quantity of meat, including a guide shell, a supply table or platform at one end of the shell and an envelope carrying cylinder comprising a cartridge arranged for placement in encircling relationship to said shell. This also effects placement of the envelope in encircling relationship to said shell. One end of the envelope, which is pulled off said cartridge and the supporting shell, will contract in a conventional manner for engaging meat pushed by hand or by a plunger from the feeding platform into and through the shell. As said meat is pushed out of said shell, it will pull the envelope with it and complete the enveloping thereof. The cartridges provide means for rapid loading of envelopes onto the packing machine and without the necessity of intermediate equipment.

3 Claims, 5 Drawing Figures

MEAT WRAPPING DEVICE

FIELD OF THE INVENTION

The invention relates to meat packing equipment and, particularly to a cartridge device for the easy and rapid loading of enveloping means, as a netting, onto a meat wrapping machine.

BACKGROUND OF THE INVENTION

There has been known for a number of years a machine generally similar to a sausage stuffer for inserting meat into wrapping or enveloping means for the purpose of improving its appearance at the point of sale. One popular embodiment of this concept involves enveloping the meat in a netting material which may either be tied at the ends or which may by appropriate resilience of the material from which it is made contract at the ends for at least partial closure thereof.

In such machines, it has been conventional to apply a tubular piece of netting over a generally tubular shell and permit one end of the netting to extend over the end of the shell for partial closure thereof either as above mentioned by its own resilience or by tying. The meat is then forced, as by a ram, through said shell against the constricted end of the netting and out of the shell. As the meat so moves against the end of the netting and out of the shell, it draws the rest of the netting with it with the result that when the meat is pushed all of the way out of the shell, the netting is wrapped around the meat and the trailing end may then either be constricted, the same as the leading end, by tying or by its own resilience.

This system of wrapping meat has been effective for many years but is subject to the inconvenience of applying the netting over the shell. If said netting is nonresilient, it is easier to apply to the shell but then the operator must take the time to effect tying of each end. If the netting is resilient in order to effect the constricting of the ends automatically, then it is more difficult to apply over the shell.

In order to meet this latter problem, means have been developed by which a resilient netting is applied to the shell mechanically. This works effectively but involves an intermediate step and extra equipment. In addition to the expense of the equipment, it requires the personnel operating the enveloping machine to expend the necessary amount of time for applying a wrapping onto the enveloping machine for each cycle of operation thereof. This as a practical matter means that the butcher usually effects such application and this not only results in relatively high-priced personnel doing a routine job but also slows the operational cycles of the enveloping machine.

Accordingly, the objects and purposes of the invention include the following:

1. To provide means adaptable for use with an otherwise conventional meat wrapping machine for quickly and easily applying a wrapping blank in operative position with respect thereto.
2. To provide means, as aforesaid, in the nature of a cartridge which can be slipped quickly and easily onto an otherwise conventional meat wrapping machine.
3. To provide means, as aforesaid, wherein a meat enveloping means, as a piece of tubular netting, may be quickly placed in operative position with respect to an otherwise conventional meat wrapping machine without the interposition of other manipulation-requiring apparatus.
4. To provide means, as aforesaid, for shortening the operating cycle of a meat wrapping machine.
5. To provide means, as aforesaid, which will improve the sterility of a meat wrapper by reducing the handling required thereof in connection with applying same to a meat wrapping machine.
6. To provide means, as aforesaid, of simple structure so that it will not increase the operating time and/or complexity of meat wrapping operation.

Other objects and purposes of the invention will be apparent to persons acquainted with apparatus of this general type upon reading the following specification and inspection of the accompanying drawings.

SUMMARY OF THE INVENTION

Briefly, the invention comprises positioning of the desired tubular envelope in telescoped relationship onto a cylindrical cartridge. Said envelope may be of any desired type, solid or net. If it is nonresilient, it may be provided with drawstrings at the respective ends thereof. If it is of a resilient nature, said ends will automatically constrict in response to said resiliency. The cartridge is telescoped onto the cylindrical shell which is conventionally provided on a meat wrapping machine, and held thereon by releasable means. The operation thereafter proceeds in the same manner as when the envelope is placed directly onto such shell, according to prior teaching.

DETAILED DESCRIPTION

Figure 1:
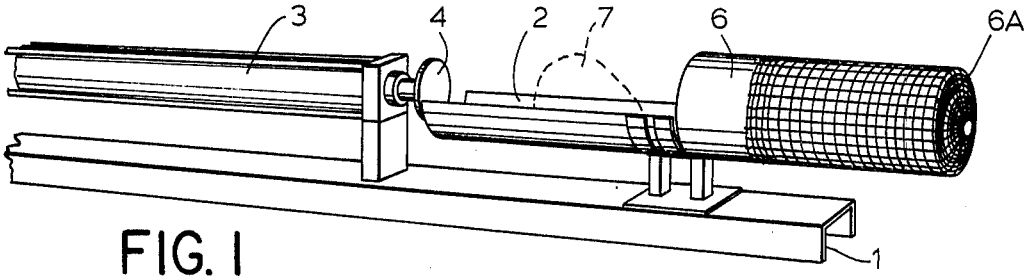
FIG. 1 is an oblique view of a conventional meat wrapping machine of the type to which the invention is applicable.

While the type of meat wrapping machine with which the invention is designed for use is known to the trade, it will be described briefly hereinafter. Referring to FIG. 1, there is provided a convenient base 1 supporting a feeding platform or table 2 and an actuating cylinder 3 in fixed relationship thereto. Said cylinder carries and reciprocally drives a plunger 4 which passes along the top of said table lengthwise thereof and in close relationship therewith. The cylindrical shell 6 is positioned serially with respect to said table 2 and coaxial with the plunger 4. The table 2 is preferably of curved cross section with at least its upper surface on the same radius as that of the shell 6, the axis of said upper surface being coaxial with the shell 6. It will be recognized that the cylinder 3 and its plunger are convenient, but not essential to the satisfactory operation of the invention. That is, the meat can be manually moved from the table 2 into and through the shell 6.

In conventional operation, an envelope of cylindrical tubing material, as a netting, is telescoped over said shell 6, often by a machine which is one of several machines well known to the trade. One such machine, by way of example, is the "Zip-Net Loader" manufactured and sold by the C & K Manufacturing & Sales Co. of Bay Village, Ohio. With the end of said net adjacent the end 6A of said shell protruding beyond said end sufficiently to enable it to be constricted to a diameter substantially less than that of said shell, a product to be enveloped, as a piece of meat or fowl, broadly indicated at 7 is placed on the table 2. Operation of said ram 4 rightwardly as appearing in FIG. 1 drives said product through the shell against the constricted end of the envelope and as the product 7 moves out of the end 6A of said shell, it pulls the envelope with it and off of said shell. As the product completely exits from the shell, the trailing end of the envelope, if same is resilient, snaps off the end of the shell and automatically constricts itself adjacent the trailing end of the product. If, of course, said envelope is not resilient, the constrictions above referred to at both the leading and trailing ends thereof may be effected by the manual manipulation and tying of a suitable drawstring.

It is the positioning of the envelope in operative position with respect to the shell 6 which it is the purpose of the present invention to facilitate and accelerate.

In carrying out the invention, there is provided a cylindrical cartridge base 8 which may be made of any convenient material, such as paperboard, ground wood, plastic or other. It is of diameter only a snug clearance distance greater than the external diameter of the shell 6 such that when said cartridge base 8 is telescoped onto said shell, it will fit snugly but slidably thereon. Some form of temporary gripping means, here resilient friction clips 9, are provided on said shell 6 under which the cartridge base 8 slips for releasable, frictional, holding thereof in position on said shell. The tubular envelope 11 is telescoped onto cartridge base 8 to comprise the completed cartridge. Said envelope may be of any conventional nature, such as sheet, foil or netting, and may be of resilient or nonresilient nature. If nonresilient, it will be provided with drawstring means in a conventional manner at the respective axial ends thereof. Normally, however, same will be of a resilient nature so that a portion thereof which is not on the cartridge base 8, as the portion 12 in FIG. 3, will automatically constrict itself as shown.

In use, a plurality of such envelopes is placed respectively onto suitable cartridge bases in any convenient manner including the use of a machine such as the "Zip-Net Loader" referred to above. This may, however, be done by much less expensive personnel than the personnel which is normally operating the wrapping machine itself and a number of such cartridges may be prepared as convenient in advance.

Figure 2:
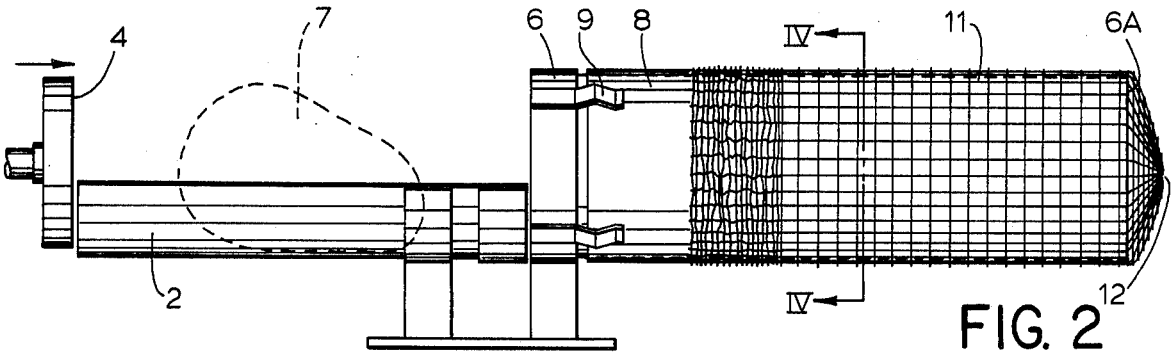
FIG. 2 is a side elevational view of the machine of FIG. 1 with an envelope carrying cartridge embodying the invention applied thereto.

In operation, a suitable cartridge is telescoped over the shell 6 and into engagement with the clips 9 as shown in FIG. 2. If the leading (here rightward) end of the envelope 11 has not been moved beyond the end of the cartridge base 8, same may now be done to permit said end to be constricted as shown at 12 in FIGS. 2 and 3.

Figure 5:
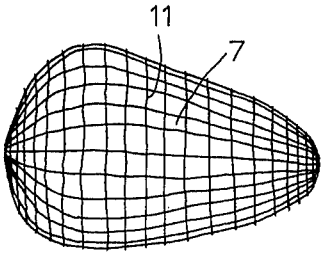
FIG. 5 is a somewhat schematicized view of a piece of meat with a completed envelope in position thereon.

A piece of meat, fowl, or other product to be wrapped and indicated at 7 is placed on the table 2 and the plunger 4 operated in any convenient manner, either manually or by power, to drive said plunger rightwardly as appearing in FIG. 2. This urges the product 7 into the shell 6 and against the leading end of the envelope or wrapper 11. In view of the constriction of the leading end of the envelope, such urging of the product thereagainst will as said product emerges from said shell draw the envelope off from the cartridge base; said base being held by the clips 9, and same, particularly if resilient, wraps itself snugly around the product. As the product completes its emergence from the shell 6, the trailing end of the envelope then constricts itself (or if nonresilient is constricted by a manually operated drawstring) so that the wrapping of the product by the envelope is completed and the finished product appears as indicated in FIG. 5, namely the same as the wrapped product obtained by previously known procedure.

Figure 3:
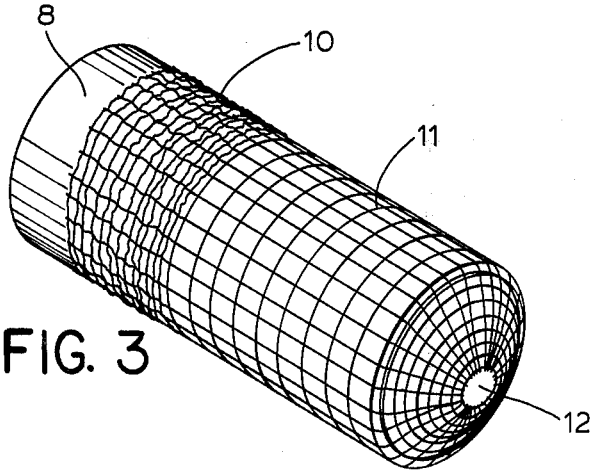
FIG. 3 is an oblique view of such a cartridge ready for application to a wrapping machine.
Figure 4:
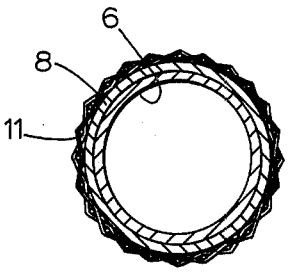
FIG. 4 is a section taken on the line IV—IV of FIG. 1.

By bunching the net-type envelope, as shown at 10 in FIG. 3, upon the cartridge base 8, a tube of netting many times the length of the base can be mounted thereon.

It will be evident from the foregoing that upon appropriate previous preparation of a number of such cartridges, the individual placement of tubular wrappings onto the shell 6 is eliminated and whenever there are a number of products to be wrapped, same can be done with much shorter operating cycles of the machine by use of such cartridges than previously, while the technique of operation is simplified and the finished product remains the same.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a meat wrapping machine having a horizontally elongated feeding table defining thereon an upwardly opening curved upper surface for supporting the meat product to be wrapped, a tubular shell fixedly positioned directly adjacent one end of said elongated table, said shell being substantially aligned with said table so that the lower interior surface of said shell effectively forms a continuation of said upper surface on said table, and a linearly reciprocal plunger positioned adjacent the other end of said elongated table and being linearly movable longitudinally along the upper surface of said table and through said shell for pushing the meat product to be wrapped from said table into and through said shell, the improvement comprising:

a plurality of substantially identical cartridge means for interchangeable telescoping application to said shell, each said cartridge means comprising a tubular base which is solely snugly and slidably telescopable externally over said shell from the end thereof remote from said table, each said cartridge means also including a tubular wrapper telescoped externally onto said tubular base with said wrapper extending across the open end of said tubular base which is remote from said table, and releasable gripping means mounted on said tubular shell and frictionally grippingly engaging the tubular base adjacent the end thereof which is disposed adjacent the table when said base is substantially fully telescoped onto said shell, whereby the gripping means increases the holding force between the base and the shell when the base is fully telescoped onto the shell to thereby securely but releasably hold the base on the shell when the meat product is pushed through the shell into the tubular wrapper.

2. A machine according to claim 1, wherein the tubular wrapper is a netting made of resilient material, said netting being snugly and resiliently telescoped over the respective tubular base.

3. A machine according to claim 2, wherein said releasable gripping means includes a plurality of resilient clips which are fixed to said shell at the end thereof adjacent said table, said clips being releasably and frictionally engageable with the adjacent end of the base when the latter is fully telescopically and slidably urged over said shell.

* * * * *